US007877864B2

(12) United States Patent
Montena

(10) Patent No.: US 7,877,864 B2
(45) **Date of Patent: *Feb. 1, 2011**

(54) COMPRESSION TOOL WITH ROTATING, MULTIPLE CABLE CRADLE

(75) Inventor: Noah P. Montena, Syracuse, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 1294 days.

This patent is subject to a terminal disclaimer.

(21) Appl. No.: 11/371,112

(22) Filed: Mar. 8, 2006

(65) Prior Publication Data

US 2007/0209183 A1 Sep. 13, 2007

(51) Int. Cl.
*H01R 43/00* (2006.01)
*H01R 43/04* (2006.01)

(52) U.S. Cl. ..... 29/749; 29/750; 29/751; 29/752; 29/758; 29/764; 29/861

(58) Field of Classification Search ..... 29/434, 29/505, 749, 750–752, 758, 761, 764, 861
See application file for complete search history.

(56) References Cited

U.S. PATENT DOCUMENTS 3,074,155 A 1/1963 Hahn et al.
3,199,334 A 8/1965 Holmes et al.
3,199,335 A 8/1965 Holmes et al.
3,738,150 A 6/1973 Holmes et al.
5,392,508 A 2/1995 Holliday et al.
5,500,998 A 3/1996 Schmode et al.
5,647,119 A 7/1997 Bourbeau et al.
6,293,004 B1 9/2001 Holliday
6,594,888 B2 7/2003 Chang
7,055,361 B2 6/2006 Hetland et al.
7,120,997 B2 10/2006 Islam et al.
7,188,507 B2 3/2007 Holliday et al.
7,299,542 B2 11/2007 Montena
7,299,543 B2 11/2007 Montena

OTHER PUBLICATIONS

Notice of Allowance (Mail Date Jun. 5, 2009) for U.S. Appl. No. 11/401,550, filed Apr. 11, 2006; Confirmation No. 4462.

*Primary Examiner*—David P Bryant
*Assistant Examiner*—Alexander P Taousakis
(74) *Attorney, Agent, or Firm*—Schmeiser, Olsen & Watts, LLP

(57) ABSTRACT

An adjustable cable compression tool having at least two driver pins and a selectable cable cradle to ensure compatibility with multiple sized wired and connectors. The driver pins are mounted on an assembly to avoid loss when the driver pin is not selected for use.

18 Claims, 9 Drawing Sheets

COMPRESSION TOOL WITH ROTATING, MULTIPLE CABLE CRADLE

FIELD OF THE INVENTION

The invention is in the field of compression tools used for compressing connector ends onto wire or cable for the production of connector cables.

BACKGROUND

The electronics, telecommunications, and cable television industries have used a variety of cables and wires to perform various jobs. Each cable or wire has various size and shaped connectors based upon either an industry standard or in some cases a proprietary manufacturing standard. The industry has used compression tools to attach various size and types of connectors onto wires. Some of the known compression tools may utilize a universal compression head in combination with an appropriate adapter to attach a connector of a specific length, diameter or other dimension.

This type of compression tool with an adjustable adapter to vary connector size is compact because it is designed to fit only one connector at a time. This is great for ease of handling and storage. Initially, in the early stages of a universal compression tool's life span the tool works as intended, but there are many drawbacks as the tool ages. One drawback is that the adapters can be lost or damaged. Another drawback is that depending on the design the additional moving parts create wear, looseness of the insert and eventual failure of the compression tool. The instant invention addresses the abovementioned drawbacks of the universal connector compression tool.

SUMMARY OF THE INVENTION

The invention is a compression tool having an adjustable driver tip assembly that may optionally contain an adjustable cable cradle to compress connectors onto a cable or wire. In one embodiment a multiple drive pin size compression tool for different wire diameters comprises a body having an interior; a handle, wherein the handle is movably attached to the body; at least one compression chamber portion within the interior of the body that is configured for receiving a connector; a cable cradle having at least two cable receiving portions of different dimensions, wherein the cable cradle is movably affixed to the body; an driver pin assembly operatively coupled to the handle, wherein said assembly has a first driver pin position and a second driver pin position; and at least two different dimensioned driver pins affixed to the driver pin assembly.

In another embodiment a multiple driver tip compression tool for multiple diameter wires comprises a body having an interior, a top, a bottom, a first side and a second side each side having a guidance portion therein; a handle, wherein the handle is pivotally attached to the body between the first side and the second side; a sliding head having a guidance component, wherein the guidance component of the sliding head is both retained and movable within the retainer portion of the body; a toggle lever affixed to the handle; a driver pin assembly having at least two differently dimensioned driver pins operatively coupled to the sliding head wherein said assembly has a first driver pin position and a second driver pin position; an compression channel portion configured to receive a first connector when the driver pin assembly is in the first driver pin position, and a second connector when the driver pin assembly is in the second driver pin position; and, an adjustable cable cradle having at least two different dimensioned receiving portions, wherein the cradle is rotatably affixed to the body between the first side and the second side.

In another embodiment is a connector compression tool for different cable diameters, said tool comprising: a body having an interior; a handle, wherein the handle is movably attached to the body; at least one compression chamber portion within the interior of the body that is configured for receiving differently sized connectors; a cable cradle having at least two cable receiving portions of different dimensions, wherein the cable cradle is movably affixed to the body; and means for compressing differently sized connectors, said means being operable with the handle.

Another embodiment is the method of affixing a cable connector to a wire comprising: providing a body having an interior, a handle, wherein the handle is movably attached to the body, at least one compression chamber portion within the interior of the body that is configured for receiving a connector, a cable cradle having at least two differently dimensioned cable receiving portions, wherein the cable cradle is rotatably affixed to the body, a driver pin assembly having at least two driver pins operatively coupled to the handle wherein said assembly has a first driver pin position and a second driver pin position, and at least two different dimensioned driver pins affixed to the driver pin assembly; providing a cable connector; providing a wire; inserting the cable connector and the wire and selecting an appropriately sized driver tip in the body that corresponds to the driver tip position; rotating the driver pin assembly to the appropriate driver tip position; rotating the cable cradle to the appropriate wire dimension position; moving the sliding head to drive the cable connector onto the wire forming a connector cable; and, removing the connector cable from the body.

DETAILED DESCRIPTION OF THE INVENTION

The invention solves the aforementioned problems of premature wear or losing driver pins by having multiple adaptor accessories mounted within the tool for interchange by the user. A multiple drive pin size compression tool 100 is made to allow for the compression of different dimensioned connecters onto different diameter wires. The tool 100 comprises a body 10 having an interior 15. The body 10 can be made of any relatively rigid material such as plastics that could be injection molded or metal that could be stamped or shaped.

Figure 1:
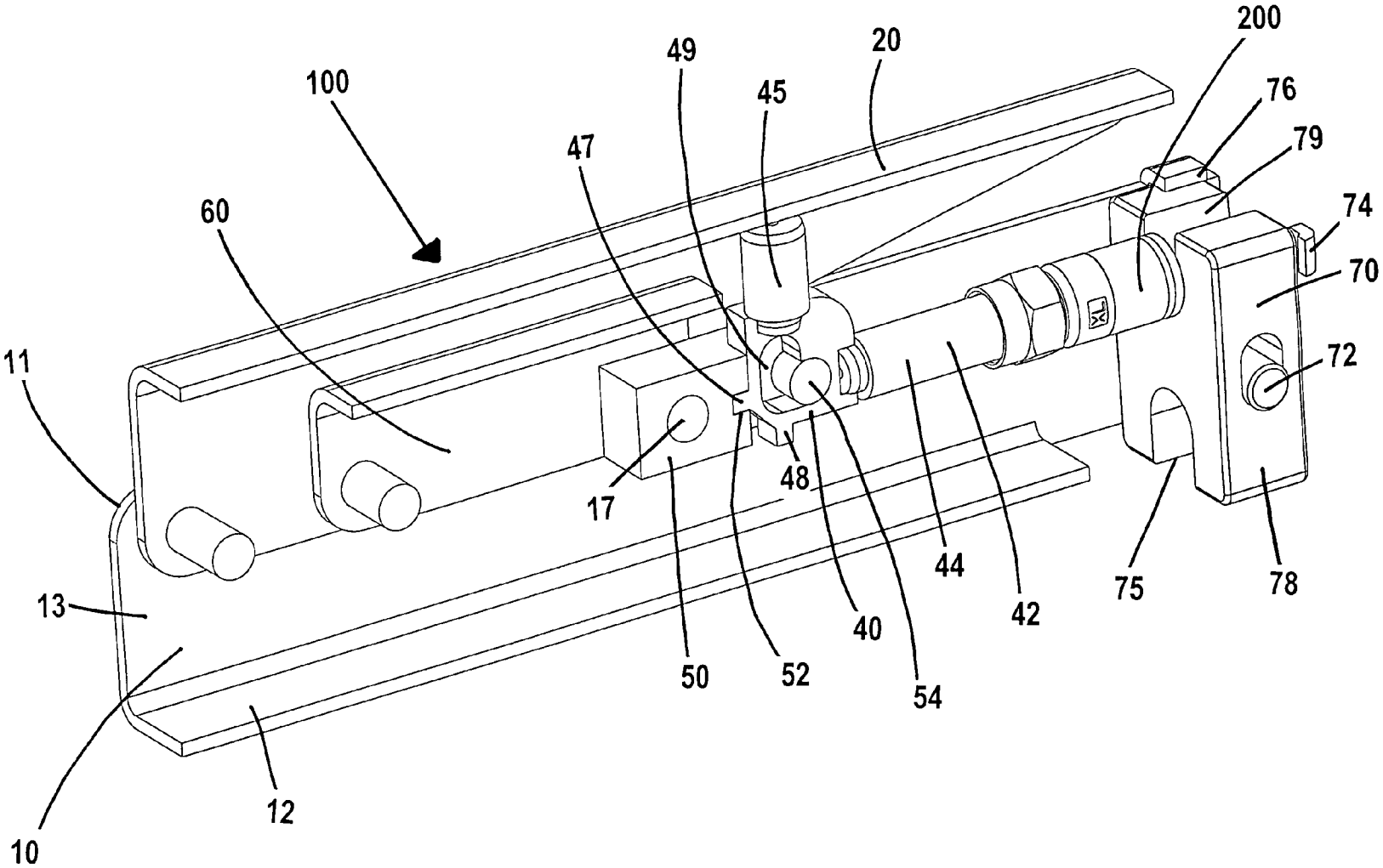
FIG. 1 shows a cross sectional view of the tool after having fully compressed a connector onto the wire.
Figure 2:
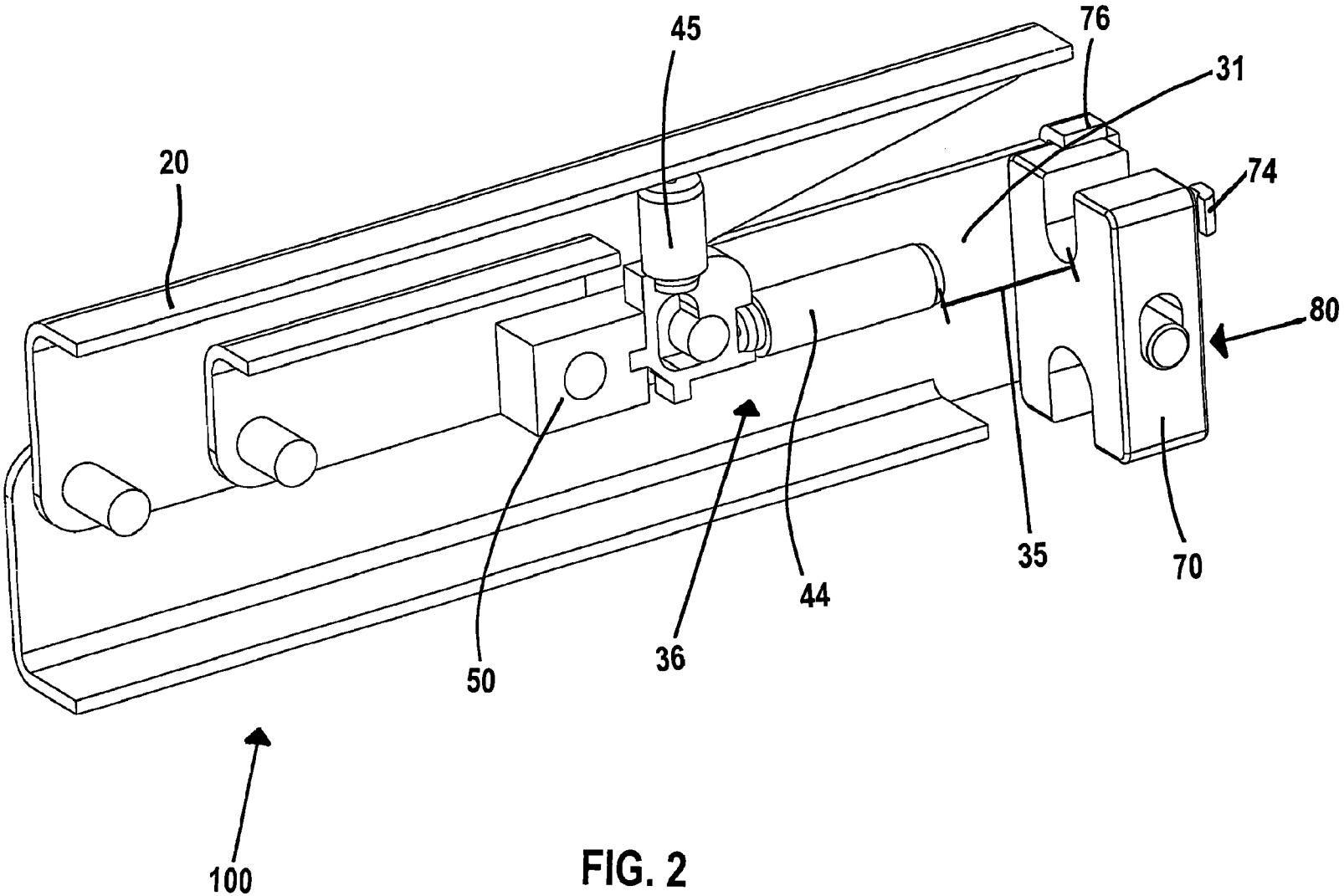
FIG. 2 shows a cross sectional view of the tool in the fully compressed position without the connector in the chamber.

A handle 20 is movably attached to the body 10. The handle 20 can be attached by rivets, screws or a hinge, but the handle 20 must be allowed to be rotatably moveable with respect to the body 10. To perform the operation of compression an operator may start by placing the connector 200 into the body 10 of the tool. There is at least one compression chamber portion 30 within the interior of the body 10 that is configured for receiving a connector 200. FIG. 1 shows a connector 200 within the compression chamber portion 30 that is substantially fully compressed onto a wire 300. FIG. 2 shows the same compression chamber 30 in the substantially fully compressed position without a connector 200 being present. When the handle 20 is raised away from the body 10 the length of the compression chamber 30 may expand sufficiently in length to fit in an uncompressed connector 200.

Adjacent the compression chamber 30 within the interior of the end of the body 10 may be a cable cradle 70 having at least two cable receiving portions 75 of different dimensions, wherein the cable cradle 70 may be movably affixed to the body 10. At the other side of the compression chamber 30 is a driver pin assembly 40 operatively coupled to the handle 20, wherein said assembly 40 has a first driver pin position 42 and a second driver pin position 43 wherein at least two different dimensioned driver pins 44, 45 may be removably affixed to the driver pin assembly. The operator may switch the assembly 40 between the two positions to select one of the correctly dimensioned pins 44, 45 from the assembly 40 to compress the connector 200.

The driver pin assembly 40 may be directly coupled to the handle 20 or to a sliding head 50 having a receiving portion 52 that is configured to interact with the driver pin assembly 40 and the handle 20. The use of the sliding head 50 together with the driver pin assembly 40 may help to stabilize the diver pin assembly 40 over being used directly coupled to the handle 20 through better angles of force being directed through the translation path of the handle. A receiving portion 52 within the sliding head 50 accepts the protruding component 47, 48 of the driver pin assembly 40. Means for compressing differently sized connectors may include the driver pin assembly 40 having at least two different dimensioned driver pins 44, 45 operable between two driver pin positions 42, 43 and configured to drive connectors having dimensions corresponding to driver pins 44, 45 and driver pin positions 42, 43. Optionally a toggle lever 60 may be affixed between the handle 20 and the sliding head 50. The toggle lever 60 may allow a greater force to be directed linearly between the driver pin 44, 45 into a connector 200 into the cable cradle 70.

The cable cradle 70 may be movable so a retaining member 74, 76 may be affixed to the body 10 to accurately position the cable cradle 70 within the body 10. This retaining member 74, 76 may help to align the cable cradle 70 so that the connector 200 can be installed without any misalignment, but the compression of a connector 200 will still work without the cable cradle retaining member 74, 76.

Figure 5:
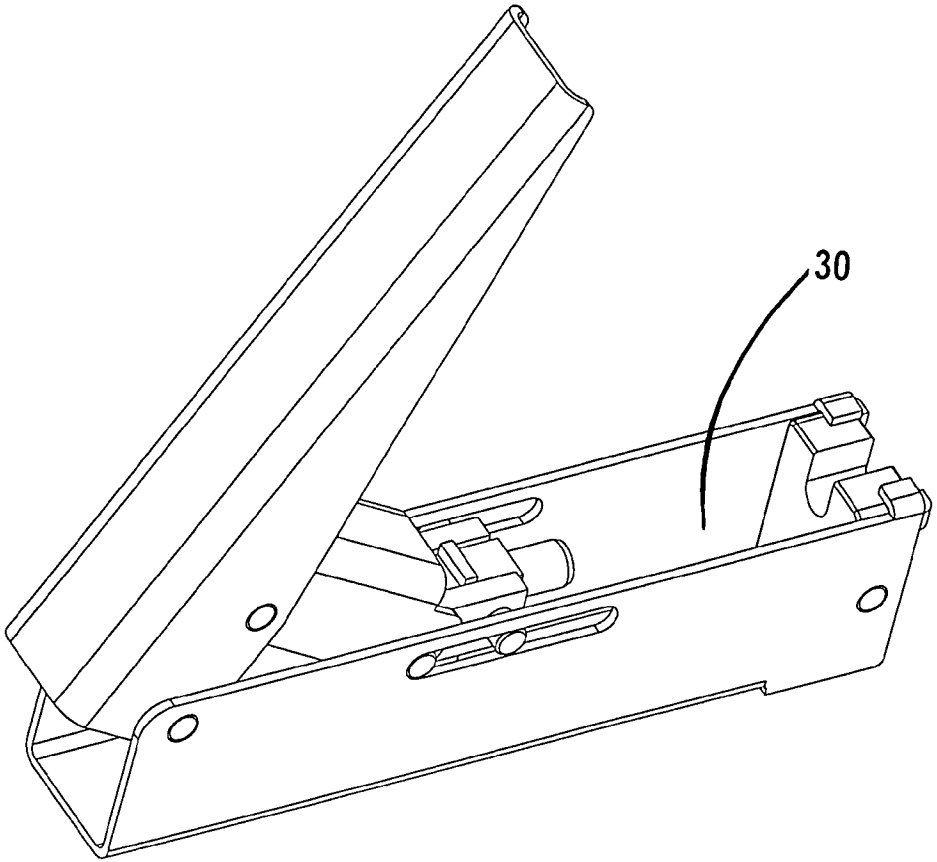
FIG. 5 shows a perspective view with the handle raised.
Figure 6:
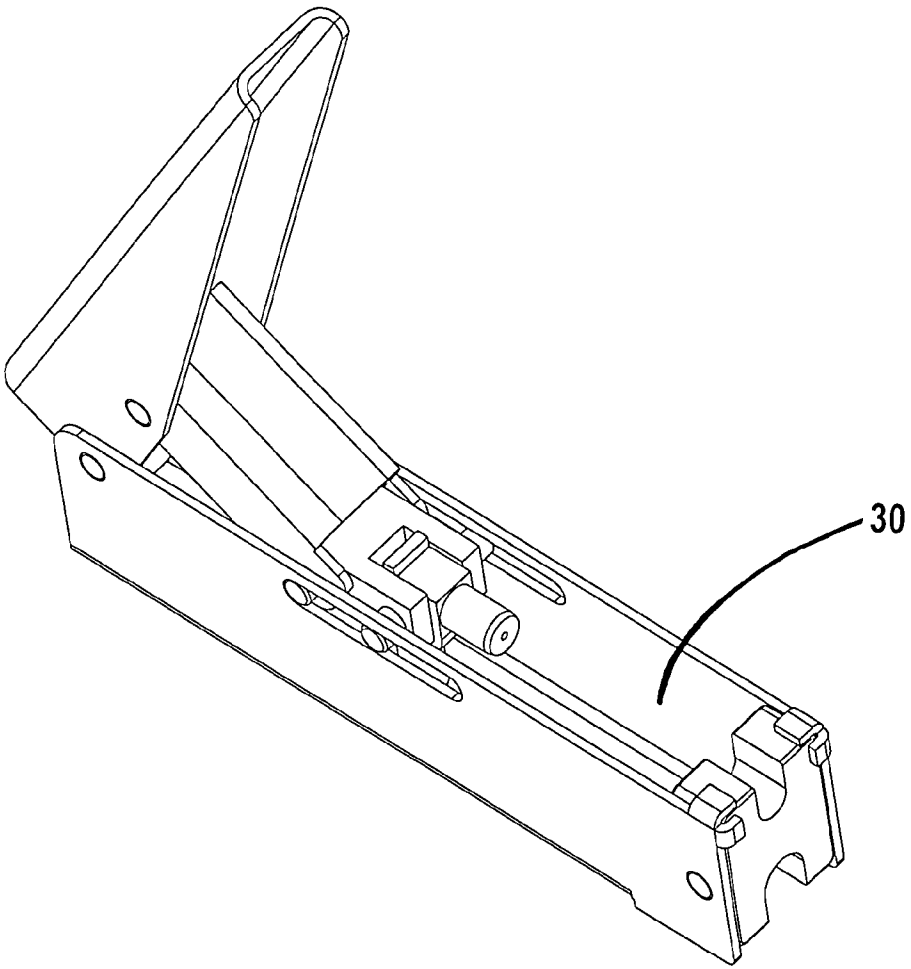
FIG. 6 shows a top perspective view with the handle raised.
Figure 7:
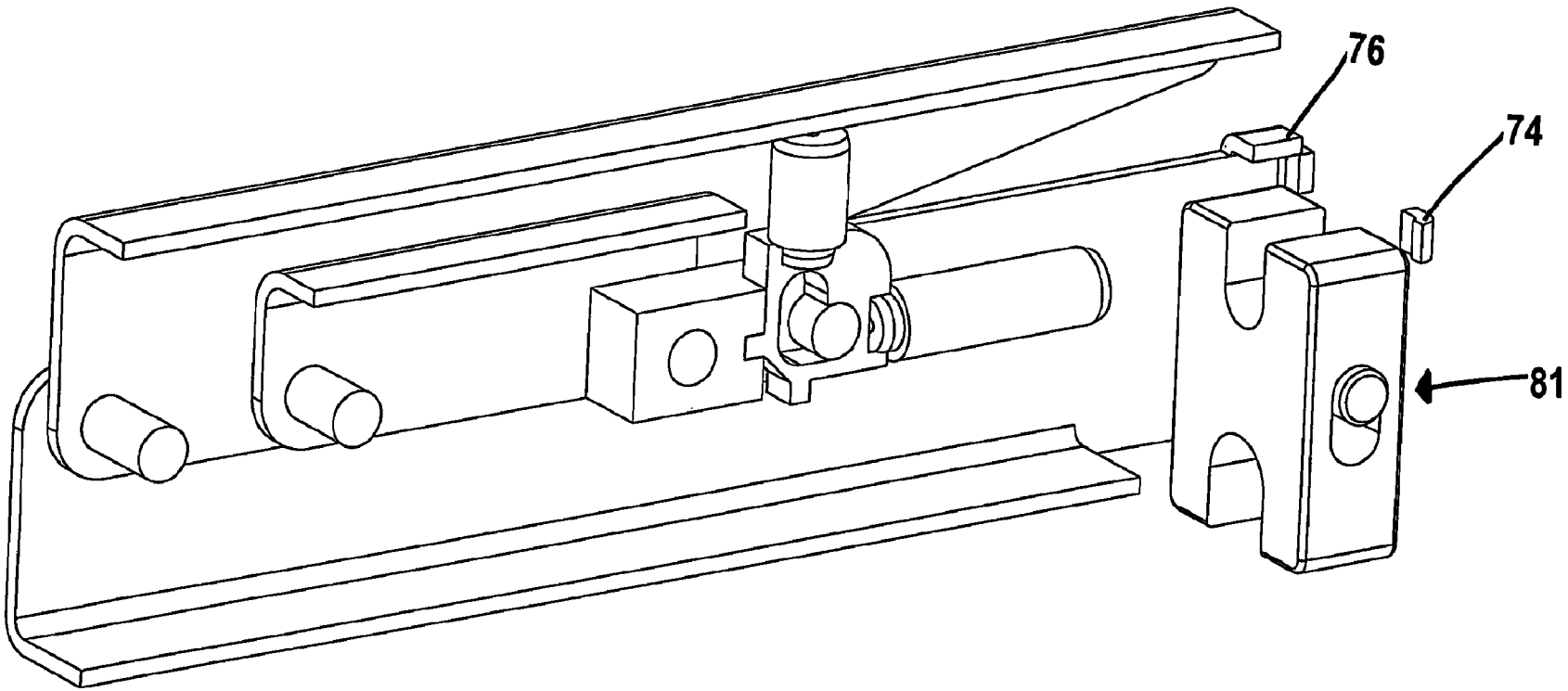
FIG. 7 shows a cross sectional view of the tool with the cable cradle in the unlocked position.
Figure 8:
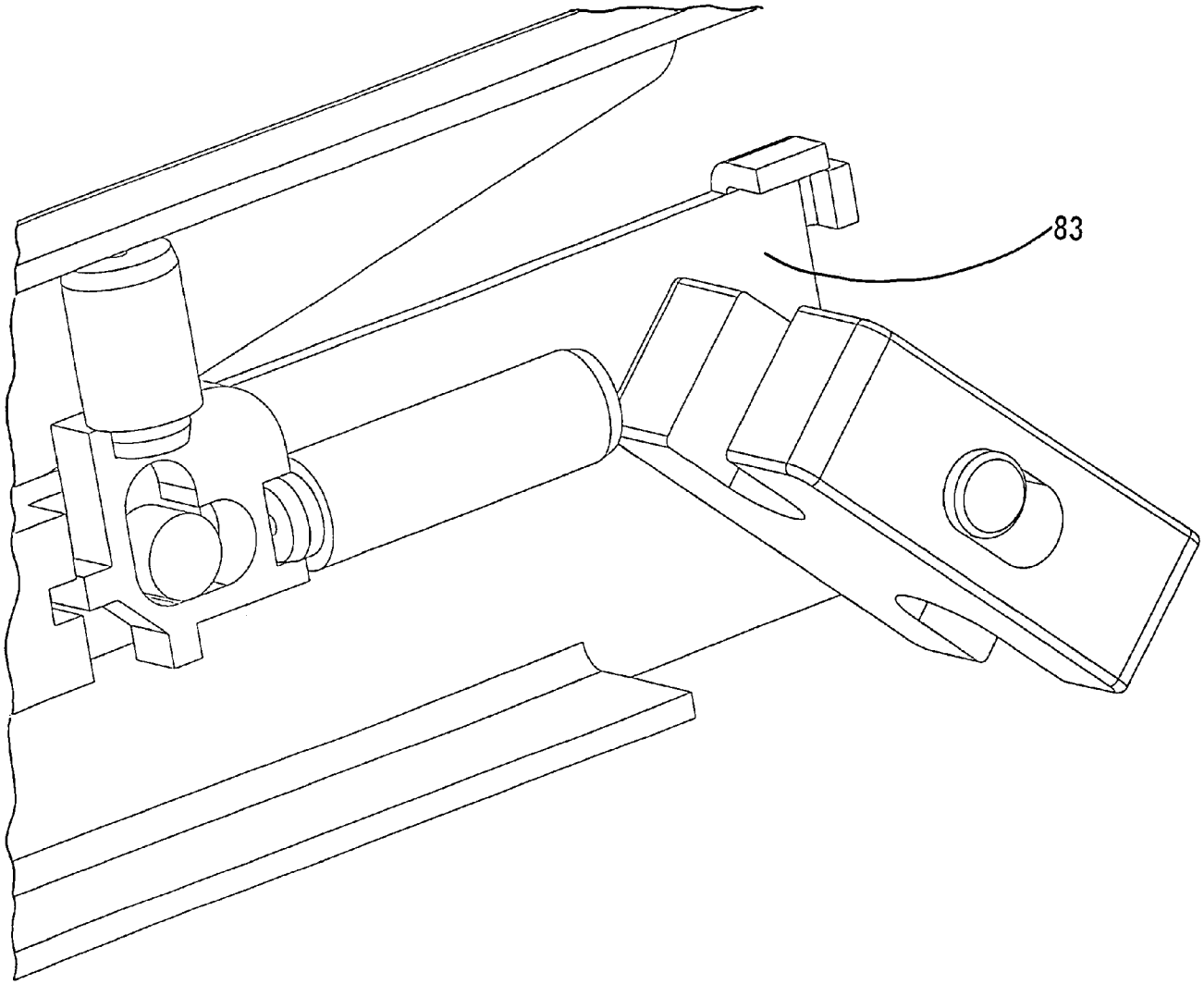
FIG. 8 shows a cross sectional view of the tool with the cable cradle being rotated to a second position.

With the handle down the distance between the end of the first driver pin 44 and the cable cradle 70 is a first compressed length 80 that corresponds to the driver pin assembly 40 being in the first driver pin position 42 as shown in FIGS. 1-4. The distance between the second driver pin 45 and the cable cradle 70 is a second compressed length 85 that corresponds to the driver pin assembly 40 being in the second driver pin position 47 as shown in FIGS. 5-7.

Figure 9:
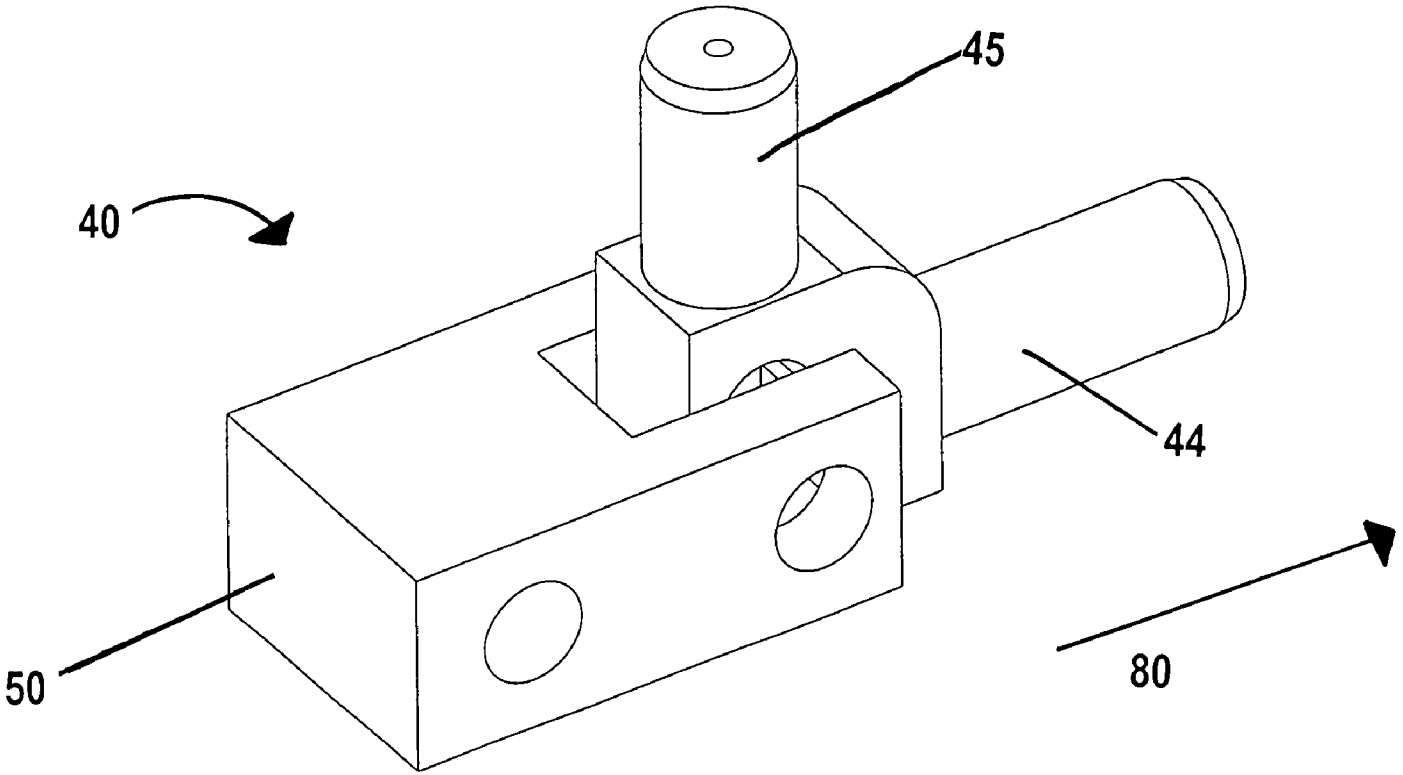
FIG. 9 shows the driver pin unlocked from the sliding head.

To move from one position to the other the driver pin assembly 40 should be unlocked from the tab receivers 52. In FIG. 9 the driver pin assembly 40 is unlocked by moving in direction 80 opposite the force of compression of the connector, which is helpful to ensure tightness of the assembly during the compression of the connector 200.

The driver pin assembly 40 has a first driver pin locking tab 47 associated with the first driver pin position 42 and a tab receiver 52 on the sliding head 50 that is engaged by sliding the tab 47 into the tab receiver 52 or instead the tab and tab receiver could be any shape with a corresponding male or female counterpart to align and secure the driver pin assembly 40. The second driver pin position 46 coincides with a second driver pin locking tab 48 being associated with the tab receiver 52. To move the driver pin assembly 40 between locked positions the tab 47 is disengaged from the sliding head 50. Other mechanical means of positioning and repositioning the driver pins of the driver pin assembly 40 can be envisioned to be equivalent. For example, a mechanical retaining system that could also suffice like a detent with a ball and spring, pin and corresponding hole, or both surfaces being flat and parallel, would be sufficient to hold the driver pin assembly 40 in proper alignment when moved between the selected positions.

Once disengaged the sliding head 50 has a protruding component 54 that is configured to interact with the driver pin assembly 40 that have an "L" shaped or other shaped hollow receiving portion 49 within the driver pin assembly 40 that would accept the protruding component 54 of the sliding head 50. If the driver pin assembly is configured to hold three driver pins it may have a "sideways T" shaped hollow section for a receiving portion 49.

To change the driver pin position of the driver pin assembly 40 locking tab 47 or 48 is disengaged from the tab receiver 52 of the sliding head 50. Once the locking tab 47, 48 is disengaged from the sliding head 50 the driver pin assembly 40 can be rotated within the "L" shaped hollow receiving portion 49 around protruding component 54 until the other locking tab 47, 48 is positioned to be inserted into the tab receiver 52 of the sliding head 50 with the desired driver pin positioned. The selected locking tab 47, 48 is then pushed into the tab receiver 52 until it is fully seated. Once seated the driver pin assembly is positioned to form a compression chamber 30 dimensioned to fit a different connector 200.

Figure 3:
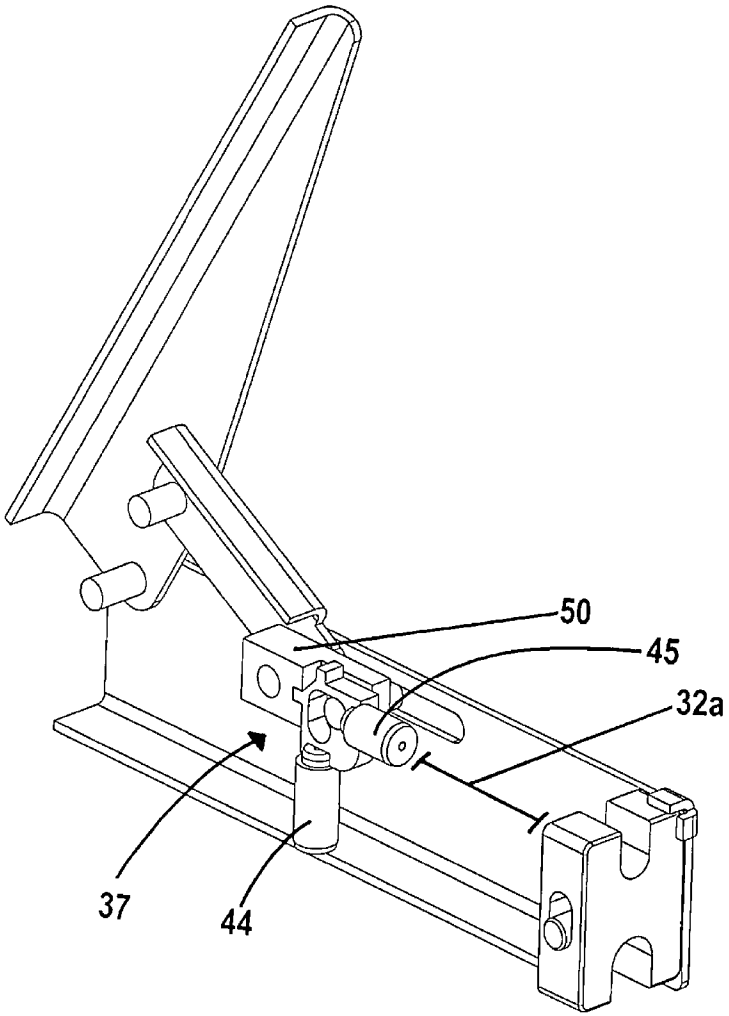
FIG. 3 shows a cross sectional side perspective view of the tool wherein the handle is moved to an uncompressed position with the driver pin in a second position.
Figure 4:
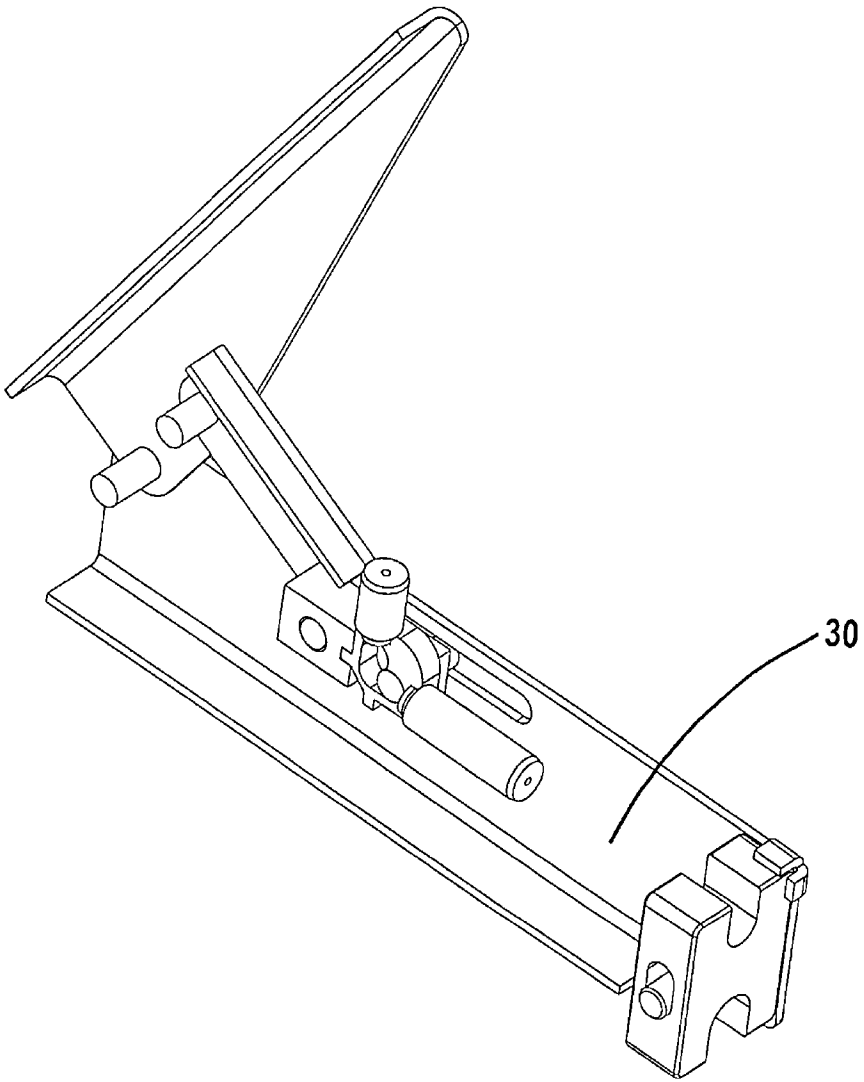
FIG. 4 shows a cross sectional perspective view of the tool wherein the handle is raised and the driver pin is in the first position.

The tool is adjustable as shown in FIGS. 3 and 4 in that it is able to form compression chambers of different compressed lengths. When the driver pin assembly is in the first driver pin position 42 it forms a first compression channel portion 31 adjacent of the sliding head 50 for receiving a connector 200 of a first dimension. When a connector 200 of a different length is present for compression then a second compression channel portion 32 adjacent of the sliding head 50 for receiving a connector 200 of a second dimension can be formed when the driver pin assembly 40 is in the second driver pin position 43. Further adjustability is possible by the complete removal of the driver pin assembly 40 and replacement with an assembly having different dimensioned driver pins or a third driver pin could be added for even greater adjustability.

When a different driver pin 44, 45 is desired it is usually because it correlates to a different sized connector 200 made for a different dimensioned wire 300. The cable cradle 70 can be adjusted to be in either a first diameter cable cradle position 78 or a second diameter cable cradle position 79 by unlocking and rotating the cable cradle 70 as shown in FIG. 4. The cable cradle 40 is in a locked position 80 in FIG. 2 when it rests against alignment stops 74, 76. To adjust the cable cradle 70 it is first slid into the unlocked position 81 away from the alignment stops 74, 76 into cable cradle opening 83. When in opening 83 the cable cradle 70 is swivelled 180 degrees until the other sized cable cradle opening is aligned. Once aligned the cable cradle 70 is slid from unlocked position 81 to locked position 80.

In another embodiment is a multiple driver tip compression tool for multiple diameter wires 100 that comprises a body 10 having an interior, a top 11, a bottom 12, a first side 13 and a second side 14 each side having a guidance portion 16 therein. To provide force to compress the connector 200, a handle 20 is provided, wherein the handle 20 is pivotally attached to the body 10 between the first side 13 and the second side 14. The handle 20 when compressed or raised directly acts upon a toggle lever 60 affixed to the handle 20. The toggle lever 60 acts upon a sliding head 50 having a guidance component 17, wherein the guidance component 17 of the sliding head 50 is both retained and movable within the retainer portion 16 of the body 10.

To compress the connector a driver pin assembly 40 having at least two differently dimensioned driver pins 44, 45 are operatively coupled to the sliding head 50 wherein said assembly 40 has a first driver pin position 42 and a second driver pin position 43. The driver assembly 40 is adjacent a compression channel portion 30 configured to receive a first connector 200 when the driver pin assembly 40 is in the first driver pin position 42, and a second connector 201 when the driver pin assembly 40 is in the second driver pin position 47. Optionally an adjustable cable cradle 70 having at least two different dimensioned receiving portions 75, 79, wherein the cradle 70 is rotatably 72 affixed to the body 10 between the first side 13 and the second side 14. The driver pin assembly 40 rests upon a protruding component 54 of the sliding head 50 within a receiving portion 49 of the driver pin assembly 40. The protruding component 54 on the sliding head 50 may be a post that removably retains the driver tip unit 40 rotatably to the sliding head 50. Optionally the tool may instead include a driver tip unit 40 that is removably affixed within the body 10 for exchange with a second driver tip unit 40*a*.

Each of the driver pins 44, 45 have a first compressed length 35 that corresponds to the compression channel portion 30 adjacent of the head 30 when the driver pin assembly 40 is in the first driver tip position 36 and a second compressed length 32 that corresponds to the compression channel portion 30 adjacent of the head when the driver pin assembly 40 is in the second driver tip position 37.

A method of affixing a cable connector 200 to a wire 300 comprises the steps of: providing a body 10 having an interior 15, a handle 20, wherein the handle 20 is movably attached to the body 10, at least one compression chamber portion 30 within the interior 15 of the body 10 that is configured for receiving a connector 200, a cable cradle 70 having at least two differently dimensioned cable receiving portions 75, 79, wherein the cable cradle 70 is rotatably affixed to the body 10, a driver pin assembly 40 having at least two driver pins 44, 45 operatively coupled to the handle 20 wherein said assembly 40 has a first driver pin position 41 and a second driver pin position 42, and at least two different dimensioned driver pins 44, 45 affixed to the driver pin assembly 40.

The next step is providing an appropriate driver pin 44, 45 for the cable connector 200 for the wire 300 and then providing a wire 300. Then inserting the cable connector 200 and the wire 300 and selecting an appropriately sized driver tip 44, 45 in the body 10 that corresponds to the driver tip position 41, 42. Then rotating or moving the driver pin assembly 40 to the appropriate driver tip position 41, 42. The next step is moving or rotating the cable cradle 70 to the appropriate wire dimension position 78.

Once the tool has been set up to the right driver pin 44, 45 and cable cradle 70 then the next step is moving the sliding head 50 to drive the cable connector 200 onto the wire 300 forming a connector cable 301; and, then removing the connector cable 301 from the body 10.

If the tool does not contain the proper sized driver tips 44, 45 then the proper step is providing a second driver tip assembly 40*a*; removing the driver tip assembly 40; and, inserting the second driver tip assembly 40*a* having an appropriately sized driver tip 44*a*, 45*a* onto the sliding head 50 in the body 10. If the tool 100 has a handle 20 to move the sliding head 50 then the proper step is compressing the handle 20 to move the sliding head 50.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

I claim:

1. A multiple drive pin size compression tool for different wire diameters comprising:

a body having an interior;

a handle, wherein the handle is movably attached to the body;

at least one compression chamber portion within the interior of the body that is configured for receiving a connector;

a cable cradle having at least two cable receiving portions of different dimensions, wherein the cable cradle is movably affixed to the body;

an driver pin assembly operatively coupled to the handle, wherein said assembly has a first driver pin position and a second driver pin position;

at least two different dimensioned driver pins affixed to the driver pin assembly;

a first driver pin locking tab associated with the first driver pin position; and a second driver pin locking tab associated with the second driver pin position.

2. The tool of claim 1 further comprising:

a sliding head having a protruding component that is configured to interact with the driver pin assembly and the handle; and, a receiving portion within the driver pin assembly accepts the protruding component of the sliding head.

3. The tool of claim 1 further comprising:

a retaining member affixed to the body to position the cable cradle within the body.

4. The tool of claim 1 further comprising:

a first compressed length that corresponds to the driver pin assembly being in the first driver pin position.

5. The tool of claim 1 further comprising:

a second compressed length that corresponds to the driver pin assembly being in the second driver pin position.

6. The tool of claim 2 further comprising:

a toggle lever affixed between the handle and the sliding head.

7. The tool of claim 2 further comprising:

a tab receiver on the sliding head.

8. The tool of claim 1 further comprising:

a first compression channel portion of the sliding head for receiving a connector of a first dimension formed when the driver pin assembly is in the first driver pin position.

9. The tool of claim 1 further comprising:

a second compression channel portion of the sliding head for receiving a connector of a second dimension formed when the driver pin assembly is in the second driver pin position.

10. The tool of claim 1 further comprising:

a first diameter cable cradle position; and a second diameter cable cradle position.

11. A multiple driver tip compression tool for multiple diameter wires comprising:

a body having an interior, a top, a bottom, a first side and a second side each side having a guidance portion therein;

a handle, wherein the handle is pivotally attached to the body between the first side and the second side;

a sliding head having a guidance component, wherein the guidance component of the sliding head is both retained and movable within a retainer portion of the body;

a toggle lever affixed to the handle;

a driver pin assembly having at least two differently dimensioned driver pins operatively coupled to the sliding head wherein said assembly has a first driver pin position and a second driver pin position;

a compression channel portion configured to receive a first connector when the driver pin assembly is in the first driver pin position, and a second connector when the driver pin assembly is in the second driver pin position; and, an adjustable cable cradle having at least two different dimensioned receiving portions, wherein the cradle is rotatably affixed to the body between the first side and the second side.

12. The tool of claim 11 further comprising:

a protruding component of the sliding head.

13. The tool of claim 11 further comprising:

a receiving portion of the driver pin assembly.

14. The tool of claim 11 further comprising:

a driver tip unit that is removably affixed within the body for exchange with a second driver tip unit.

15. The tool of claim 11 further comprising:

a first compressed length that corresponds to the compression channel portion of the head when the driver pin assembly is in the first driver tip position.

16. The tool of claim 11 further comprising:

a second compressed length that corresponds to the compression channel portion of the head when the driver pin assembly is in the second driver tip position.

17. The tool of claim 11 wherein the protruding component on the sliding head is a post that retains the driver tip unit rotatably to the sliding head.

18. A connector compression tool for different cable diameters, said tool comprising:

a body having an interior;

a handle, wherein the handle is movably attached to the body;

at least one compression chamber portion within the interior of the body that is configured for receiving differently sized connectors;

a cable cradle having at least two cable receiving portions of different dimensions, wherein the cable cradle is movably affixed to the body; and means for compressing differently sized connectors, said means being operable with the handle;

wherein the means includes an driver pin assembly operably coupled to the handle, said assembly having a first driver pin position and a second driver pin position, at least two different dimensioned driver pins affixed to the driver pin assembly, a first driver pin locking tab associated with the first driver pin position, and a second driver pin locking tab associated with the second driver pin position.

* * * * *

UNITED STATES PATENT AND TRADEMARK OFFICE

CERTIFICATE OF CORRECTION

PATENT NO. : 7,877,864 B2
APPLICATION NO. : 11/371112
DATED : February 1, 2011
INVENTOR(S) : Noah P. Montena It is certified that error appears in the above-identified patent and that said Letters Patent is hereby corrected as shown below:

claim 1, line 12, “an driver pin” should read --a driver pin--.
claim 18, line 14, “an driver pin” should read --a driver pin--.

Signed and Sealed this
Nineteenth Day of April, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,877,864 B2
APPLICATION NO. : 11/371112
DATED : February 1, 2011
INVENTOR(S) : Noah P. Montena It is certified that error appears in the above-identified patent and that said Letters Patent is hereby corrected as shown below:

Column 6, line 33 (claim 1, line 12) “an driver pin” should read --a driver pin--.
Column 8, line 28 (claim 18, line 14) “an driver pin” should read --a driver pin--.

This certificate supersedes the Certificate of Correction issued April 19, 2011.

Signed and Sealed this
Seventeenth Day of May, 2011

David J. Kappos

David J. Kappos
*Director of the United States Patent and Trademark Office*